US005413286A

United States Patent [19]

Bateman

[11] Patent Number: 5,413,286

[45] Date of Patent: May 9, 1995

[54] WASTE PROCESSING MACHINE

[75] Inventor: Ivor Bateman, Mt. Pleasant, Mich.

[73] Assignee: Tramor, Inc., Remus, Mich.

[21] Appl. No.: 138,839

[22] Filed: Oct. 15, 1993

Related U.S. Application Data

[63] Continuation of Ser. No. 874,751, Apr. 27, 1992, abandoned.

[51] Int. Cl.[6] ..... B02C 13/04

[52] U.S. Cl. ..... 241/190; 241/194; 241/287

[58] Field of Search ..... 241/189.1, 194, 190, 241/191, 287, 288, 193

[56] References Cited

U.S. PATENT DOCUMENTS

| | | | |
|---|---|---|---|
| 1,759,905 | 5/1930 | Keith | 241/49 |
| 1,761,083 | 6/1930 | Liggett | 241/32 |
| 1,947,784 | 2/1934 | Armstrong | 241/194 |
| 2,348,916 | 5/1944 | Magnus | 241/101.1 |
| 2,822,138 | 2/1958 | Olive | 241/194 |
| 3,186,651 | 6/1965 | Briolini | 241/194 X |
| 3,254,687 | 6/1966 | Tertyshnikov | 241/191 X |
| 3,482,788 | 12/1969 | Newell | 241/189.1 X |
| 3,743,191 | 7/1973 | Anderson | 241/73 |
| 3,912,175 | 10/1975 | Anderson | 241/73 |
| 3,966,128 | 6/1976 | Anderson et al. | 241/73 |
| 4,033,515 | 7/1977 | Barcell et al. | 241/27 |
| 4,066,216 | 1/1978 | Waldrop et al. | 241/190 |
| 4,082,231 | 4/1978 | Gould | 241/194 X |
| 4,106,706 | 8/1978 | Burrows | 241/186.2 |
| 4,120,458 | 10/1978 | Hughes | 241/186.35 |
| 4,210,289 | 7/1980 | Arnoldy | 241/27 |
| 4,364,526 | 12/1982 | White | 241/186.4 |
| 4,485,976 | 12/1984 | White | 241/186.2 |
| 4,773,601 | 9/1988 | Urich et al. | 241/101.7 |
| 4,802,631 | 2/1989 | Arasmith | 241/88.1 |
| 4,846,411 | 7/1989 | Herron et al. | 241/101.7 |
| 4,997,135 | 3/1991 | Zehr | 241/101.7 |
| 5,005,620 | 4/1991 | Morey | 241/101.7 |
| 5,154,363 | 10/1992 | Eddy | 241/190 X |

*Primary Examiner*—Kenneth E. Peterson

*Attorney, Agent, or Firm*—Varnum, Riddering, Schmidt & Howlett

[57] ABSTRACT

The invention is a waste processor which incorporates the advantages of the chipper knife holder 100, swing hammers 50 and hog 120. A swing hammer 54 is used, providing for the use of all the kinetic energy stored in the swing hammers 54 together with good material contact. The swing hammer 54 profile is designed to spread the impact force over a large area, thus increasing the life of the swing hammer 54. If necessary, the swing hammers 50 can be locked to the rotating disc assembly 18, preventing their contacting any material. Hog hammers 120 are placed immediately behind the swing hammers 50. The position of the hog hammers 120 is such that they provide room for the swing hammers 50 to recoil, but are close enough to impact the material in approximately the same place as the swing hammers 50. The hog hammers 120 use the much larger amount of kinetic energy that is stored in the rotating disc assembly 18. The hog hammers 120 are clamped to a specifically designed tool holder 90 which protects the hog hammers 120 and machine from damage when the hog hammer 120 impacts an unbreakable object. The specially designed tool holders 90 can also mount a chipper knife holder 100 having a knife 106 used for chipping. The waste processor provides the flexibility to combine the free-swinging hammers 50, hog hammers 120 and chipper knife holder 100 in various combinations on the disc assembly 18.

50 Claims, 8 Drawing Sheets

WASTE PROCESSING MACHINE

This is a continuation of application Ser. No. 07/874,751, filed Apr. 27, 1992, now abandoned.

BACKGROUND OF THE INVENTION

1. Field of the Invention

This invention relates to a waste processing machine; more specifically, to a waste processing machine incorporating a combination chipper, swing hammer and hog hammer.

2. Description of the Related Art

A variety of devices are provided to comminute and chip discarded waste products. Currently, four types of equipment are generally used for this purpose: chippers (disc and drum types), hammermills, hogs and shredders. Shredders operate much slower than the other three types and are more suited for processing metals and rubber products.

Chippers are generally constructed around a rotating disc or drum. The chippers mount a plurality of blades to the rotating disc or drum and shear the wood products into chips. Hammermills are generally constructed around a plurality of rotating discs having a plurality of free-swinging hammers attached at the periphery of each disc, providing for the transferring of a portion of the kinetic energy stored in the rotating discs to the wood products through the rotating hammers. Hogs are similar to hammermills except that the hammers are rigidly secured to the periphery of the rotating discs. Hammermills and hogs may also be constructed with a drum.

Of chippers, hammermills and hogs, chippers are generally much more efficient, requiring less horsepower to chip the material while simultaneously being more productive. Chippers can chip logs and trees up to 40 inches in diameter, as well as small brush. They are also used to produce a dimensionally similar chip for the paper industry. A major disadvantage of chippers is that they require reasonably "clean" wood in order for the chipper knives to remain sharp. Any foreign material such as nails, spikes, rocks and sand will quickly dull the knife cutting edge. For this reason, chippers are not suited for reducing wood waste such as pallets, construction refuse or paper products.

A hammermill will break up pallets, paper products, construction materials and small tree branches. The kinetic energy stored in the free-swinging hammers is used to break up the material. Because the hammers do not have the same requirement for sharp edges as chipper knives, dirty material is easily processed by a hammermill. A hammermill also has the advantage that the rotatable hammers will recoil backwardly if the hammer cannot break the material on impact. This built-in safety feature permits the hammers to protrude several inches beyond the discs that support them, making it possible for the hammers to make good contact with the material.

However, a known disadvantage of the hammermill is that the size of the free-swinging hammers is limited. The hammers rely on centrifugal force to hold them in a radially-outward position ready for impact. Upon impact, they may swing back rapidly which produces an unbalancing force on the mill. If the hammermill turns too fast or the hammers are too heavy, a large vibration will occur. For this reason, the amount of kinetic energy that can be stored in the free-swinging hammers is limited. This, in turn, limits the size of the logs being processed to approximately six inches in diameter.

A hog is similar to a hammermill except that the hog hammers are fixed to the discs or drum and do not rotate relative to the disc assembly. The hog has two advantages over the hammermill. First, the disc assembly or drum always remains balanced because the hog hammers do not swing. Second, the hog hammer uses the full kinetic energy that is stored in the rotating disc assembly or drum to do the work on the waste products. Normally, the stored energy in the disc assembly or drum is far greater than the stored energy in the free-swinging hammers. Typically, logs up to eight or nine inches in diameter can be processed with a hog. The upper limit is dictated by the amount of power available and the structural limits of the hog assembly.

Because hog hammers are rigidly attached to the disc assembly or drum, there is a greater possibility of damaging the machine when the hog hammers contact material which cannot be readily broken upon impact. Because of possible machine damage, hog hammers do not normally protrude radially outwardly as far as free-swinging hammers. A large protrusion would also require much more power to force the hammer through the material. Typically, a hog hammer would protrude only about half as much as a free-swinging hammer. The resulting reduction in material contact area can push the material away from the hog hammer head rather than draw it into the disc assembly or drum, reducing the productivity and efficiency of the machine.

The related art does not disclose a waste processor which combines the attributes of a chipper, hammermill and hog. However, one design has attempted to combine the attributes of a hog hammer with a hammermill. This design provided for a limited swing of the free-swinging hammer. The design provided for the swinging hammer to protrude above the disc assembly the same distance as the typical free-swinging hammers, but the backward swing or recoil is restricted by a dead stop, wherein a portion of the hammer still protrudes radially outwardly from the disc assembly. At this point, further movement of the hammer is stopped and the swinging hammer has the attributes of a hog hammer.

This compromise arrangement enables the hammers to initially make good contact with the material being processed while using the large amount of kinetic energy stored in the disc assembly to do the work on the material. One disadvantage of this compromise arrangement is that the hammers receive two blows. The first blow occurs when the hammer impacts the material, but a damaging blow may occur when the hammer makes contact with the dead stop. A second disadvantage is that the hammer tip must be designed so that the hammer presents an impact face to the material in its laid back position that will not push the material away from the hammerhead. The required hammer profile for this arrangement rapidly changes shape as the hammer wears, resulting in a loss of performance.

SUMMARY OF THE INVENTION

The invention is directed to a waste processor for comminuting and chipping waste material. In the preferred embodiment, the waste processor comprises a generally cylindrical housing having an inlet opening on one side and an outlet opening on the other side. A main shaft is axially mounted within the housing and is connected to a drive means, providing for the rotation of the main shaft within the housing. There are at least two discs mounted axially on the main shaft which rotate correspondingly with the shaft. A bearing shaft extends between the discs mounted on the main shaft. A swinging hammer is rotatably mounted to the bearing shaft between the two discs so that a portion of the swinging hammer extends radially beyond the periphery of the discs. The discs are adapted to mount a hog hammer and a chipper knife at the discs' periphery so a combination of swinging hammers, hog hammers and chipper knives can be used in a single waste processor to comminute and chip a variety of waste materials.

In one aspect, the waste processor has a stationary hammer mounted to the housing and which projects radially inwardly of the housing to a point near the periphery of the discs.

In another aspect, the waste processor has a tool support which mounts near the periphery of the discs.

Preferably, a stationary hammer is mounted to the housing in approximately the same plane as each disc and a stationary hammer is also mounted to the housing approximately mid-way between the plane of adjacent discs.

In yet another aspect, a hog hammer is mounted to the tool support and extends beyond the periphery of the disc.

In a further aspect, a knife assembly is mounted to the tool support and extends beyond the periphery of the discs. Preferably, the knife assembly has a knife holder which retains a knife blade so that the cutting edge of the knife blade extends slightly beyond the periphery of the discs.

Preferably, the discs have a disc aperture positioned radially inwardly from the periphery of the discs and aligned with each other. The swinging hammer has a shank with a base aperture which is positioned so as to align with the disc apertures when the swinging hammer is rotated radially inward, providing the fixing of the swinging hammer with respect to the discs by a single rod which passes through the disc apertures and the base aperture.

Preferably, the swinging hammer has a bearing surface which extends around the bearing shaft, and the coefficient friction between the bearing surface and the bearing shaft is not less than 0.20.

Preferably, the tool support is a block having a leading edge and a trailing edge. The trailing edge is disposed in the direction of rotation of the discs. The block has a mounting surface which extends between the leading edge and trailing edge. The mounting surface is coincident with an imaginary plane sloping from the leading edge to the trailing edge at an acute angle from an imaginary line intersecting the plane at a tangent point on the periphery of the disc.

Preferably, the tool support is radially spaced 45 degrees from the bearing shaft along the periphery of the discs.

Preferably, the block extends axially from the disc to abut an adjoining block on an adjacent disc, forming a single tool support which extends between adjacent discs. Parallel t-slots are disposed in the mounting surface of the block along lines extending from the leading edge toward the trailing edge of the block. The angle of the block is generally 35 degrees. The block mounts to the disc so that the block is recessed from the periphery of the disc.

Preferably, each block has opposed side edges which extend from the leading edge to the trailing edge, three t-slots intermediate the side edges, and a half t-slot at each side edge, so that when adjacent blocks are abutted, a whole t-slot will form at the side edges. The hog hammers can be mounted to the mounting surface of the block by tightening bolts and nuts located in the t-slots which provide for the hog hammer to slide down the mounting surface of the block if the hog hammer cannot break the waste material on impact. The knife assembly is also mounted to the mounting surface by tightening bolts and nuts in the t-slots. In another embodiment, three stationary hammers are disposed in substantially the same plane as at least one of the discs and the outlet opening is disposed between two of the stationary hammers.

Preferably, there are four swing hammers radially spaced 90 degrees apart along the periphery of the discs.

In another aspect, a waste processor which comminutes and chips waste material has a housing in which a main shaft is mounted. The main shaft is connected to a drive means, providing for rotating the main shaft within the housing. A disc is axially mounted to the main shaft and rotates with the main shaft. The disc mounts an improved tool support at the periphery of the disc. The improved tool support comprises a block having a leading edge and a trailing edge. The trailing edge is disposed in the direction of rotation of the discs. The block has a mounting surface which extends between the leading edge and trailing edge. The mounting surface is coincident with an imaginary plane sloping from the leading edge to the trailing edge at an acute angle from an imaginary line intersecting the plane at a tangent point on the periphery of the disc.

BRIEF DESCRIPTION OF THE DRAWINGS

The invention will now be described with reference to the drawings in which.

DETAILED DESCRIPTION OF THE PREFERRED EMBODIMENTS

Figure 1:
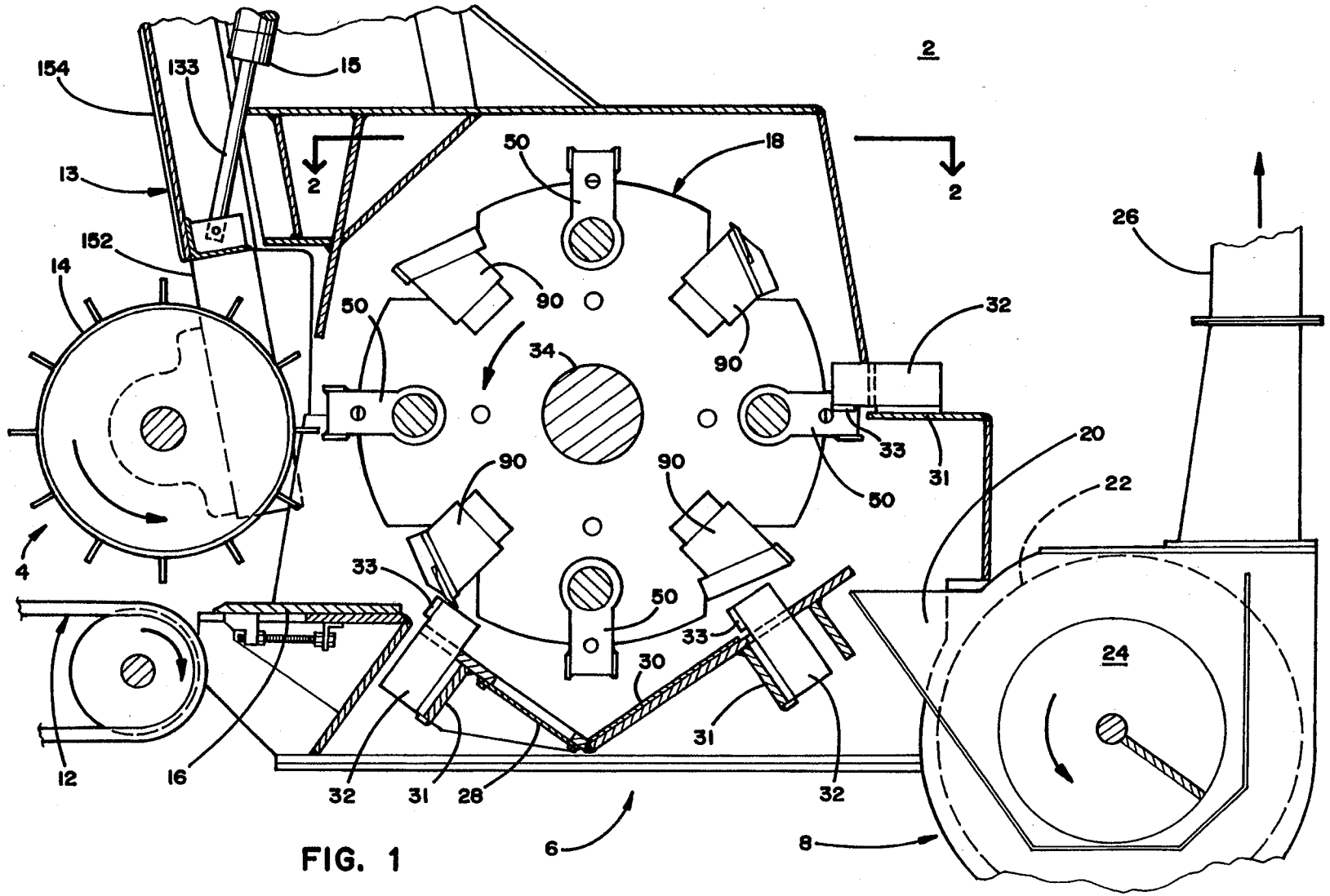
FIG. 1 is a side elevational view of the waste processor according to the invention.

Referring now to the drawings, FIG. 1 illustrates a waste processing machine 2 which can combine the attributes of a chipper, hammermill and hog, according to the invention, for comminuting and chipping waste material. The waste processing machine 2 comprises three major functional systems: the infeed system 4, the mulching system 6 and mulch expelling system 8. Waste material enters the waste processing machine 2 through the infeed system 4 where it is directed to the mulching system 6. The mulching system 6 breaks and chips the waste material into a mulch which is directed into the mulch expelling system 8. The mulch expelling system 8 can either expel the mulch from the waste processing machine 2 by a screw conveyor or by an impeller.

The infeed system 4 and mulch expelling system 8 are known. It is also known to use chippers, swing hammers and hog hammers separately to process waste material. The invention provides for uniquely combining the best attributes of the chippers, swing hammers and hog hammers to create a waste processing machine that can easily process any type of waste by varying the combination of chippers, swing hammers and hog hammers as needed.

Figure 11:
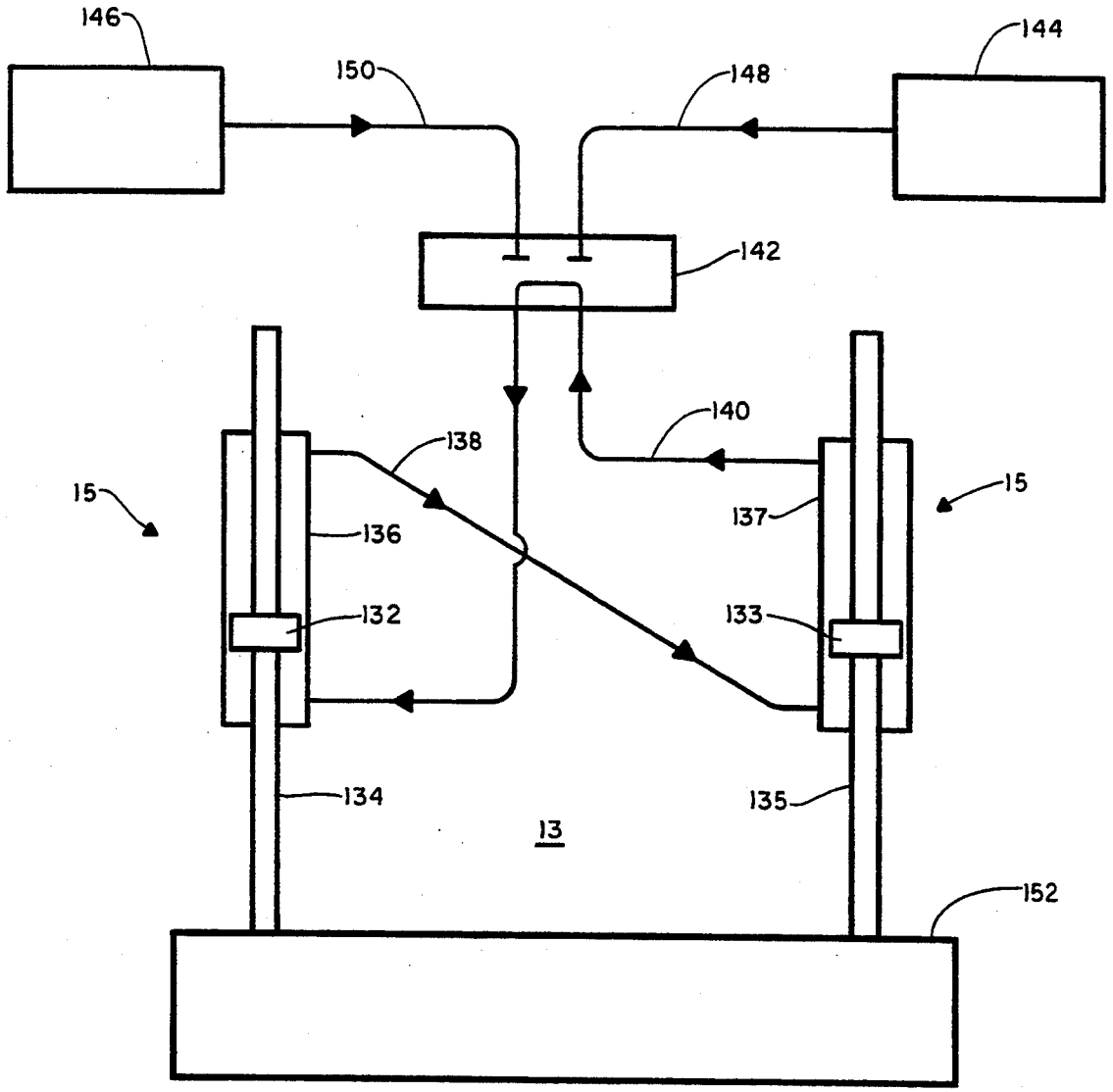
FIG. 11 is a schematic illustration of the hydraulic leveling system according to the invention.

The infeed system 4 comprises infeed conveyor 12, feedwheel slide system 13 and adjustable anvil 16. The feedwheel slide system 13 comprises feedwheel 14, hydraulic cylinders 15, slide box 152 and box frame 154. (FIG. 11) An inlet opening 17 is defined by the space between the feedwheel 14 and infeed conveyor 12. The waste material is placed on the infeed conveyor 12 which moves the material into contact with the feedwheel 14 which pushes the material through the inlet opening 17 and onto the adjustable anvil 16 which is adjacent to the mulching system 6. Material passing under the feedwheel 14 can cause the feedwheel slide system 13 to tilt resulting in possible binding of the feedwheel slide system 13. The hydraulic cylinders 15 are mounted to each end of the feedwheel slide system 13, providing for the automatic leveling of the feedwheel if it begins to bind.

After the waste material is comminuted by the novel mulching system 6, the mulch is expelled from the waste processor 2. The mulch expelling system comprises discharge tube 20, impeller 22, screw conveyor 24, and thrower discharge 26. The discharge tube 20 is mounted at the lower rear of the disc assembly 18. The screw conveyor 20 is mounted to the bottom of the discharge tube 20. The impeller 22 is mounted at one end of the screw conveyor 20 and the thrower discharge is mounted above the impeller 22. The mulched material is passed from the disc assembly 18 through the discharge tube 20 to the screw conveyor 24 where the mulch is either moved out of the waste processing machine 2 by the screw conveyor 24 or passed on to the impeller 22 by the screw conveyor where it is blown out.

Figure 2:
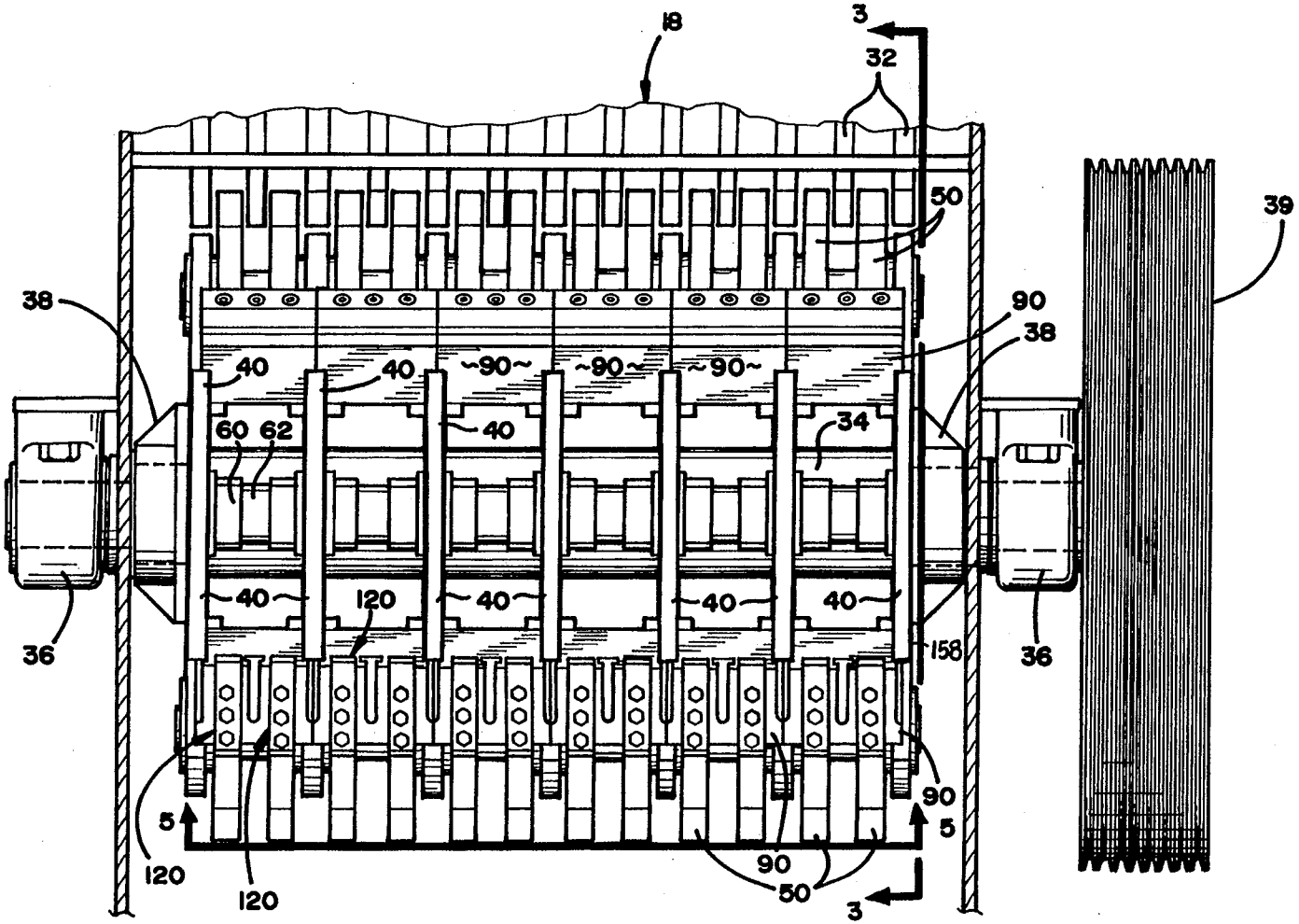
FIG. 2 is a top view of the waste processor along line 2—2 of FIG. 1.

The novel mulching system 6 according to the invention is now described in greater detail. Referring to FIGS. 1 and 2, the mulching system 6 comprises disc assembly 18, maintenance covers 28, wear plate 30, and stationary hammers 32. The disc assembly 18 further comprises main shaft 34, pillow blocks 36, discs 40, swing hammers 50, swing hammer bearing 60, tool holder 90, chipper knife holder 100, and hog hammer 120. Main shaft bearings 38 are rigidly connected to the pillow blocks 36. The main shaft 34 passes through the main shaft bearings 38 and pillow blocks 36, and rides on the main shaft bearings 38. One end of the main shaft 34 passes through the associated pillow block 36 and is connected to a belt pulley 39. The belt pulley 39 is connected to a power source (not shown) and can accommodate single or multiple belts. Preferably, the belt pulley 39 accommodates multiple belts.

A plurality of discs 40 are mounted to the main shaft 34. The main shaft 34 passes through main shaft holes 42 of the discs 40. The number of discs 40 used is only limited by the available power to turn the main shaft 34 and width of the discs 40. However, it is preferable that seven discs 40 are mounted on the main shaft 34 with equal spacing between each disc. The discs 40 are preferably forty-two inches in diameter. The preferred disc spacing is approximately 9 inches on center between adjacent discs 40.

Preferably, there are three sets of stationary hammers 32. The three sets of longitudinally spaced stationary hammers 32 are positioned at the periphery of the disc assembly 18. The stationary hammers 32 are rigidly mounted to the stationary hammer mounting plates 31. Preferably, the stationary hammers 32 are mounted to the mounting plates 31 in groups of two or three to ensure proper spacing between the stationary hammers 32 and for ease of handling. The stationary hammers 32 are also mounted to the mounting plates 31 so that a stationary hammer 32 is in the same plane as each disc 40 and there is a stationary hammer 32 approximately at the midpoint between the centers of adjacent discs 40. In a waste processing machine 10 having seven discs 40, the corresponding number of stationary hammers is thirteen per set or thirty-nine total.

The first set of longitudinally spaced stationary hammers 32 is preferably located above the maintenance covers 28. The second set of stationary hammers 32 is preferably located adjacent to the wear plate 30. The third set of stationary hammers 32 is preferably located above the discharge tube 20. The hammer tip 33 of the stationary hammers 32 is disposed slightly away from the outer periphery of the discs 40, preventing the discs 40, chipper knife holder 100, and hog hammers 120 from contacting the stationary hammers as the discs 40 are rotated. The forward most set of stationary hammers 32 is lower than the adjustable anvil 16, providing for moving the adjustable anvil 16 over the stationary hammers 32 and in close proximity to the discs 40.

Figure 4:
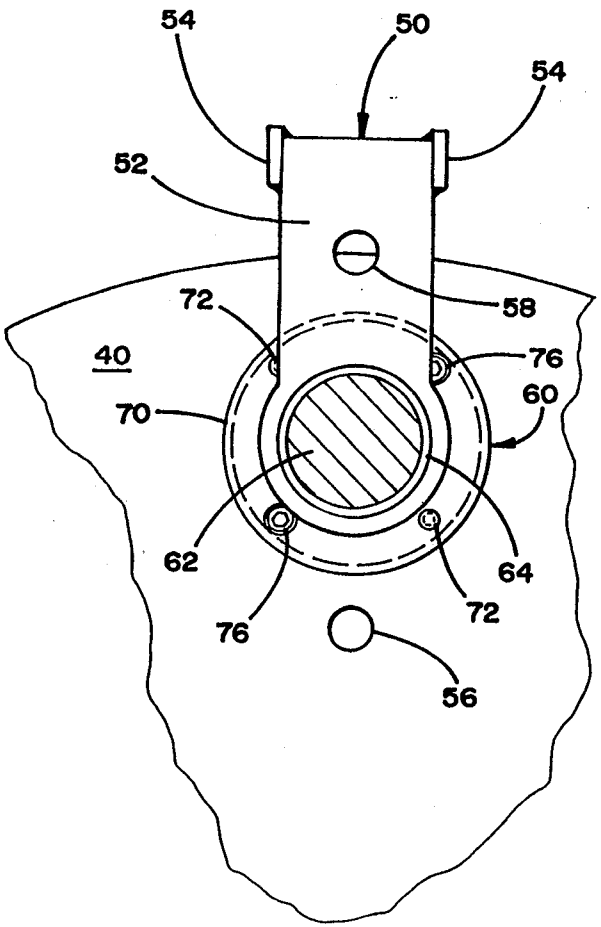
FIG. 4 is a partial side view of the waste processor shown in FIG. 3.
Figure 3:
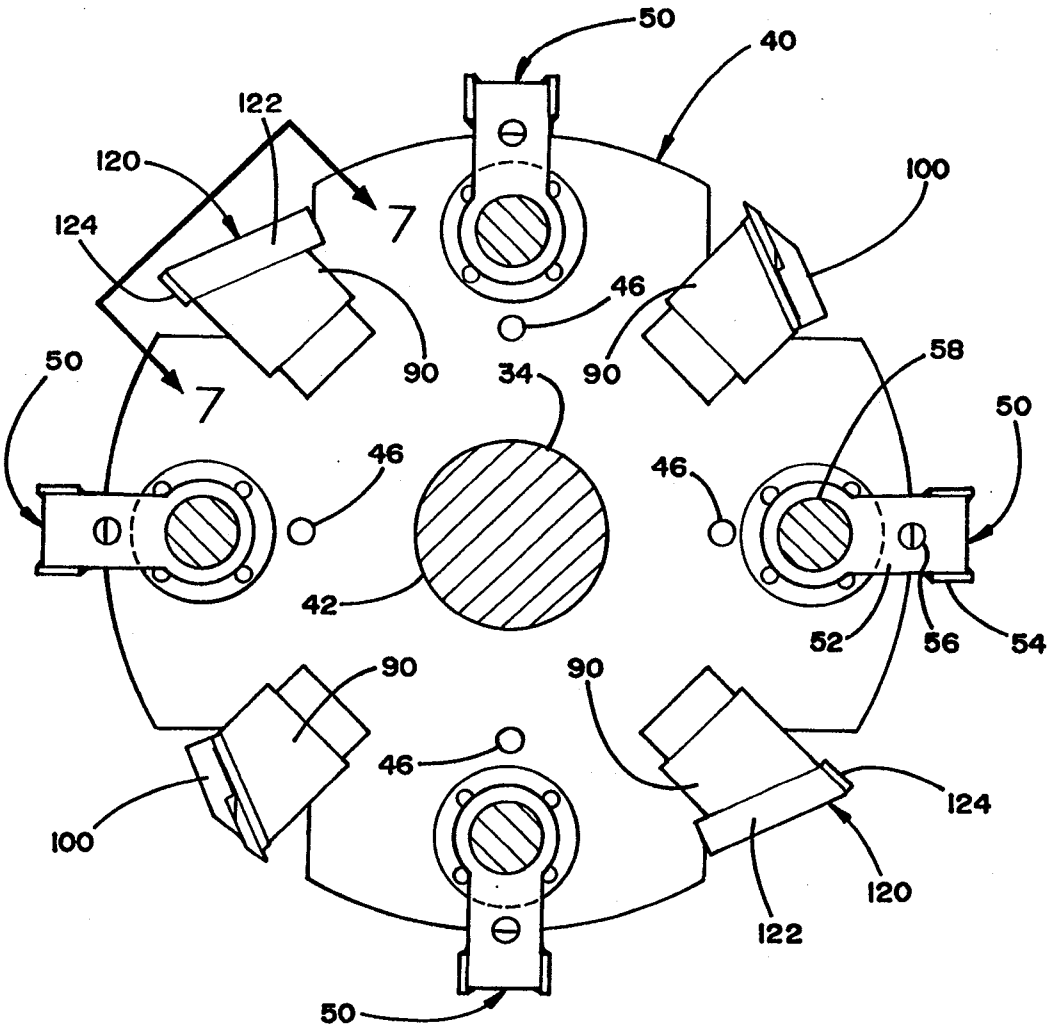
FIG. 3 is a side view of the waste processor along line 3—3 of FIG. 2.
Figure 5:
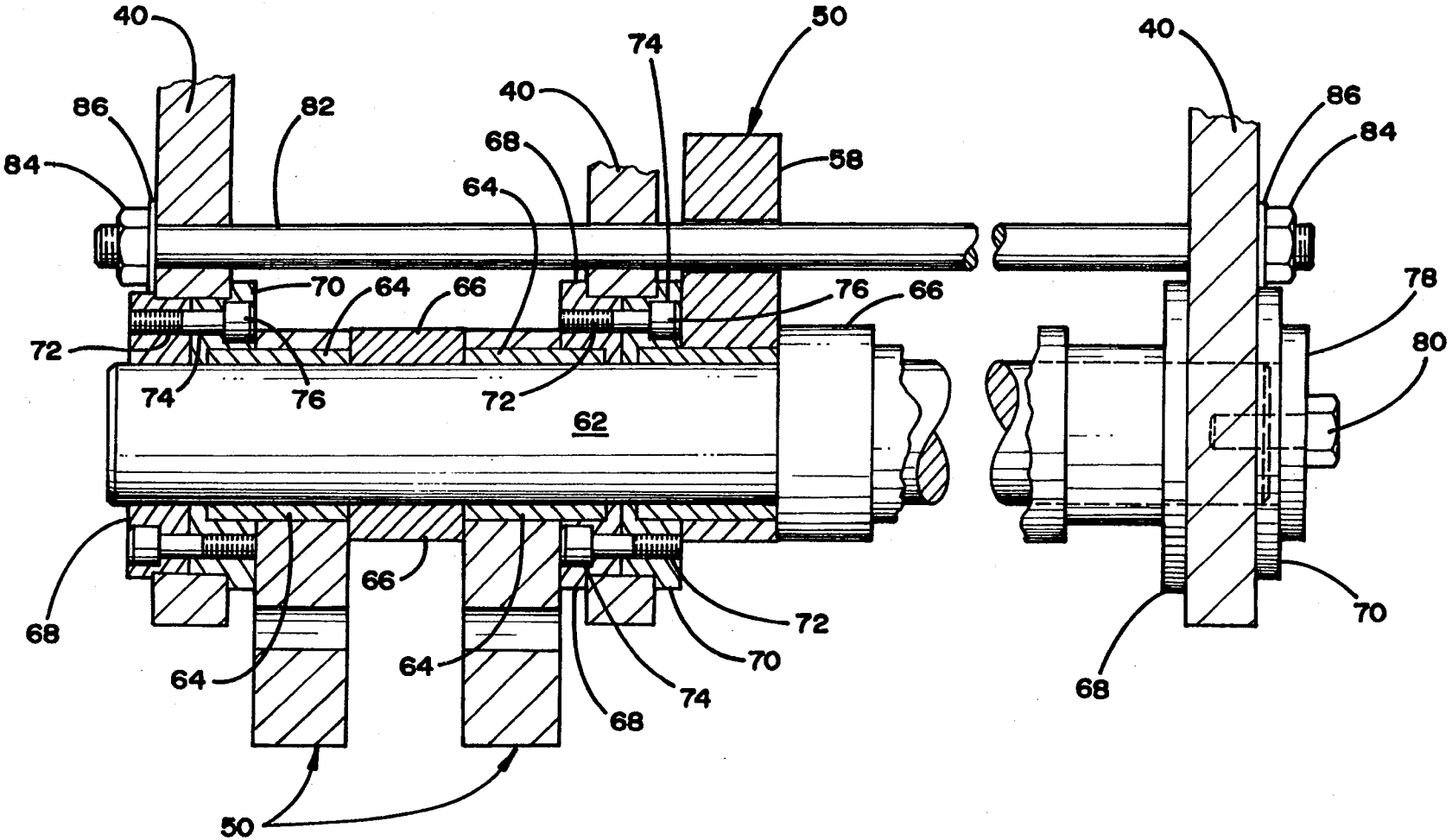
FIG. 5 is a partial sectional view of the waste processor along the line 5—5 in FIG. 2.

Referring to FIGS. 4 and 5, the swing hammer 50 comprises a shank 52 and hammers 54. The swing hammer bearing 60 comprises bearing shaft 62, sleeve bearings 64, spacers 66, outer mounting collars 68, inner mounting collars 70, and end plates 78.

The swing hammer bearing 60 is connected to each disc 40 by the outer mounting collar 68 and inner mounting collar 70. Both the inner mounting collar 70 and outer mounting collar 68 are inserted through a swing hammer bearing hole 48 on each disc 40, until flanges 69, 71 of the outer mounting collar 68 and inner mounting collar 70, respectively, contact the sides of each disc 40. A threaded bolt 76 is inserted into countersunk openings 74 and threaded into threaded openings 72 until tight, drawing the outer mounting collar 68 and inner mounting collar 70 into tight abutment with the disc 40.

The inner and outer mounting collars 68, 70 surround the sleeve bearings 64, retaining the sleeve bearings 64 in the desired position. The outer most discs 40 on each end of the main shaft 34 only have sleeve bearings 64 mounted on the inner surface of the outer most discs 40. All the other discs 40 have aligned sleeve bearings 64 on each side of each disc 40. The spacer 66 is placed between adjacent sleeve bearings 64. The spacers 66 are preferably located at approximately the center of the distance between adjacent discs 40. The outer mounting collar 68, inner mounting collar 70, sleeve bearing 64, and spacer 66 are all rotatably mounted to the bearing shaft 62. Both ends of the bearing shaft 62 are bolted to the outermost mounting collar 68 by end plates 78 and bolts 80.

The swing hammers 50 are rotatably mounted to the sleeve bearings 64. The sleeve bearing 64 passes through the bearing hole 58 of the swing hammer 50. The spacer 66 prevents the swing hammers 50 from moving longitudinally with respect to the bearing shaft 62, during the rotation of discs 40. The spacers 66 also keep the swing hammers 50 disposed between the stationary hammers 32 as the disc assembly 18 is rotated. Preferably, the swing hammers 50 and bearings 60 are positioned on the disc 40 so that the swing hammers will protrude approximately 3 inches beyond the circumference of the discs 40, advantageously providing the swing hammers with the ability to not only break up the waste, but to draw in and compress the waste towards the disc assembly 18 which aids chipper knives 106 in cutting.

The size of the swing hammer bearing 60 is preferably quite large compared to similar bearings on a typical hammermill. It is known that hammermills and especially the hammers themselves are high-wear items. The life of a swing hammer 50 varies widely, but for a hammermill similar to the invention, the typical life is approximately 200 hours. The increased bearing diameter and width will increase the hammer life to approximately 1000 hours. Further, the larger bearing diameter provides for a greater friction torque to counteract the retrograde motion of the swing hammer after impact. If there was no friction in the swing hammer bearing 60, the swing hammer would continue to rotate in retrograde motion forever after impact, resulting in the swing hammer rotating away from any future blow.

The larger diameter swing hammer bearing 60 produces a greater frictional torque because the friction force by a bearing is independent of the bearing area and the torque created by the friction of the bearing is equal to the friction force multiplied by the radius. The radius is measured from the axis of rotation of the bearing shaft 62 to the outer diameter of the sleeve bearing 64. The axis of rotation of the bearing shaft 62 is preferably located 16 inches radially outward from the axis of rotation of the main shaft 34. Therefore, as the diameter of the sleeve bearing 64 is increased, so is the radius, and for a constant frictional force the associated frictional torque is increased proportionally. Preferably, the outer diameter of the sleeve bearing 64 is $3\frac{5}{8}$.

Preferably, the friction coefficient of the swing hammer bearing 60 is not less than 0.25 which provides for the swing hammer 50 to assume its original position within one revolution of the disc 40. The combination of the centrifugal force imparted to the swing hammer by the rotating disc 40 and the friction torque of the swing hammer bearing 60 retards the retrograde motion of the swing hammer after impact. With a friction coefficient not lower than 0.25, the swing hammer should stop spinning in a retrograde motion during the first 180° after impact. The centrifugal force imparted to the swing hammer 50 by the disc assembly 18 will then accelerate the hammer in the opposite direction so that the swing hammer 50 reaches its original position in time for the next blow. At this moment, the hammer 50 has a rapid forward motion. The hammer tip speed is almost twice the nominal tip speed relative to the rotating disc assembly.

Still referring to FIG. 5, if it is desired not to use the swing hammers during the processing of the waste, the swing hammers 50 can lock to the disc 40 so that the swing hammers 50 do not protrude beyond the circumference of the disc 40. To lock the swing hammers 50 to the discs 40, the swing hammers 50 are rotated until locking holes 56 of the swing hammers 50 align with swing hammer locking holes 46 of the discs 40. A locking bar 82 is then inserted through the aligned swing hammer locking holes 46 of the discs 40 and the locking holes 56 of the swing hammers 50. The ends of the locking bar 82 are secured in place by nuts 84 which thread onto the ends of the locking bar 82, contacting the washers 86 which tighten against the outermost discs 40. In the locked position, the swing hammers 50 will not interfere with the operation of the waste processing machine 10.

Figure 8:
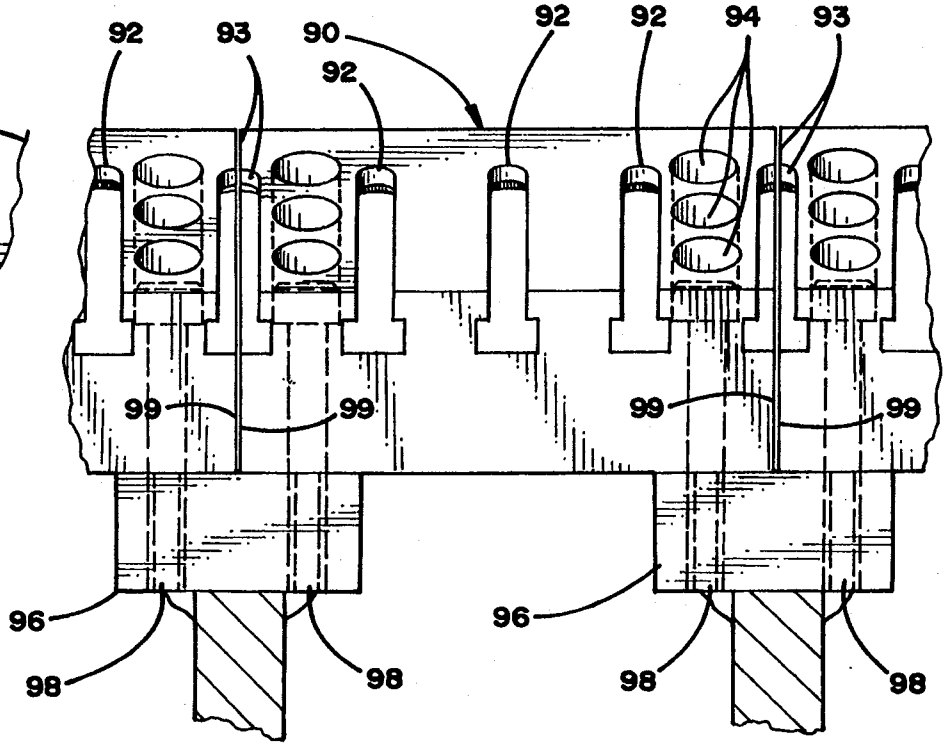
FIG. 8 is a partial sectional view of the waste processor along the line 8—8 in FIG. 6.
Figure 6:
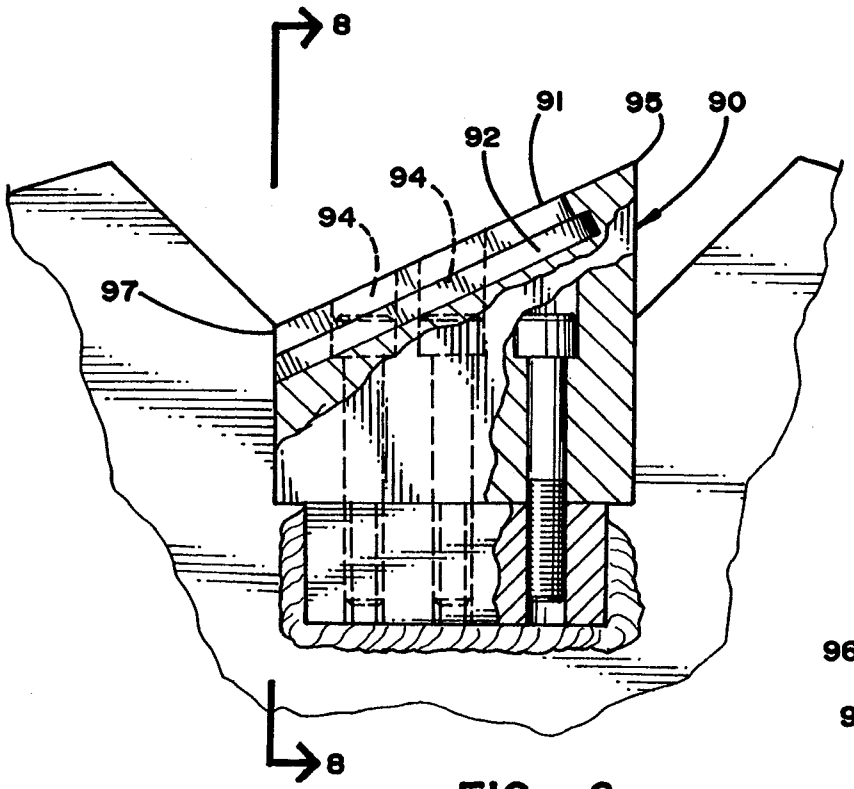
FIG. 6 is a partial sectional view of the waste processor shown in FIG. 3.
Figure 7:
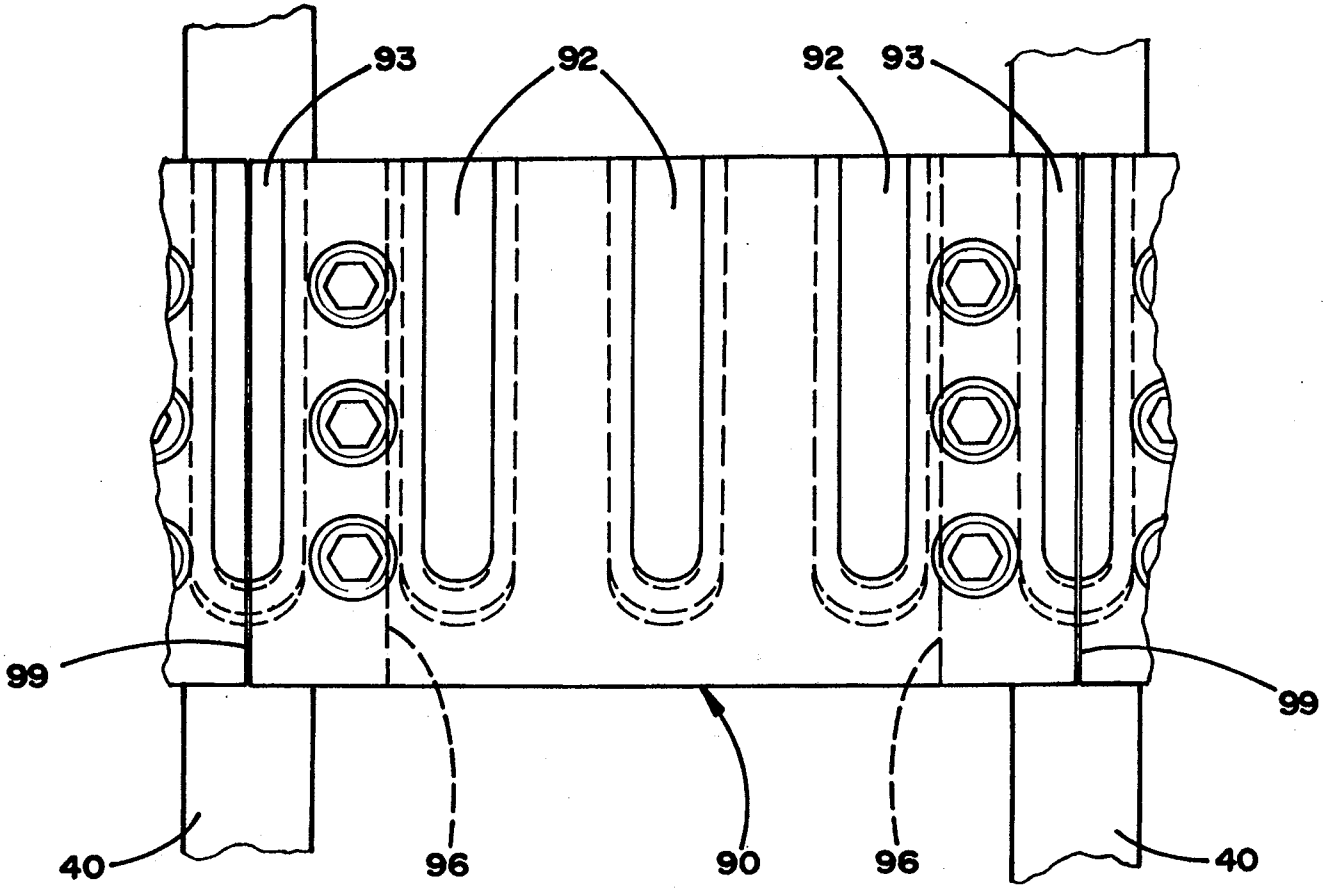
FIG. 7 is a partial sectional view of the waste processor along line 7—7 of FIG. 3 with the hog hammer removed.

Referring now to FIGS. 6–8, the tool holder 90 has mounting surface 91, T-slots 92, and mounting holes 94. The tool holder mounting block 96 has mounting holes 98. Each side of the tool holder 90 is mounted to a disc 40. Each disc 40 has a tool holder mounting block 96 welded to the lower most portion of the tool holder slots 44. The bottom of the tool holder 90 rests on the upper surface of the adjacent tool holder mounting blocks 96. The mounting holes 94 of the tool holder 90 align with the holes 98 of the tool holder mounting block 96. Bolts 99 are inserted through the mounting holes 94 of the tool holder 90 and are threaded into the threaded holes 98 of the tool holder mounting blocks 96, securing the tool holders 90 to the tool holder mounting blocks 96. The ends of the tool holder 90 lie on the center line of the associated disc 40, providing for the tool holders 90 to mount to adjacent discs 40 and span across the width of disc assembly 18.

The mounting surface 91 of the tool holder 90 has leading edge 95 and trailing edge 97. The perimeter of the mounting surface is defined by the leading edge 95, trailing edge 97 and ends 99. Preferably the mounting surface 91 forms approximately a 35° angle with respect to a line that is tangent to the disc 40 at the point on the disc 40 directly below the tip of the knife 106 or hog hammer tip 124, whichever tool is mounted to the tool holder 90. The tool holders 90 have half T-slots 93 at there ends which form a complete T-slot 92 when the tool holders are mounted adjacent to each other, providing for the mounting of chipper knife holder 100 or hog hammers 120 across adjacent tool holders 90.

Figure 9:
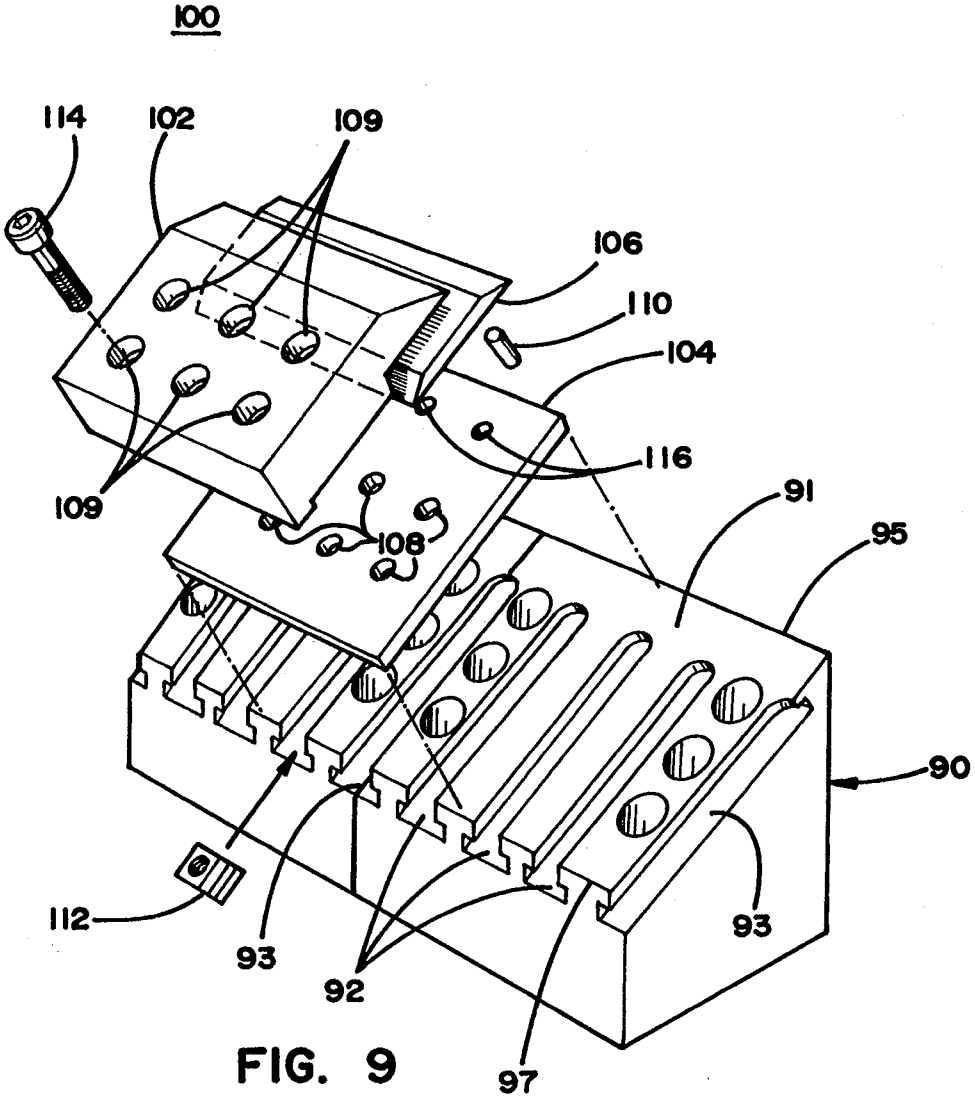
FIG. 9 is an exploded view of the chipper blade and tool holder according to the invention.

Referring to FIG. 9, the chipper knife holder 100 mounts to the tool holder 90. The chipper knife holder 100 comprises clamp 102, counter knife 104, and knife 106. The counter knife 104 has holes 108. The clamp 102 has countersunk holes 109. T-nuts 112 slide in the T-slots 92 of the tool holder 90. The knife 106 and counter knife 104 have corresponding knife holes 116 and 118.

The chipper knife holder 100 is mounted to the tool holder 90 by T-nuts 112 which are slidably mounted in the T-slots 92 of the tool holder 90. The T-nuts 112 receive the socket head cap screws 114 through the holes 108 of the counter knife 104 and the countersunk holes 109 of the clamp 102. The socket head cap screws 114 are then threaded into the T-nuts 112 and tightened to secure the chipper knife holder 100 to the tool holder 90. The knife 106 is secured to the counter knife 104 by a set screw 110 threaded into the corresponding knife holes 116 and 118. The knife 106 protrudes slightly beyond the circumference of the disc 40, preferably ½ inch. The chipper knife holder 100 can mount many other types of knives. It is known to use a knife having slots instead of knife holes 116, providing for radially adjusting the knife with respect to the discs 40.

The preferred knife width is any width shorter than the distance between the outer most discs 40 of the disc assembly 18. Preferably, the knives 106 are not as wide as the tool holders 90. The knives 106 are preferably mounted to the tool holders with gaps between successive knives 106. Therefore, it is preferred to have at least two rows of knives 106, and the different rows of knives 106 are offset to eliminate any gaps during contact of the knives 106 on the waste material. However, it is possible to mount the knives 106 across the disc assembly without having any gaps between adjacent knives.

Figure 10:
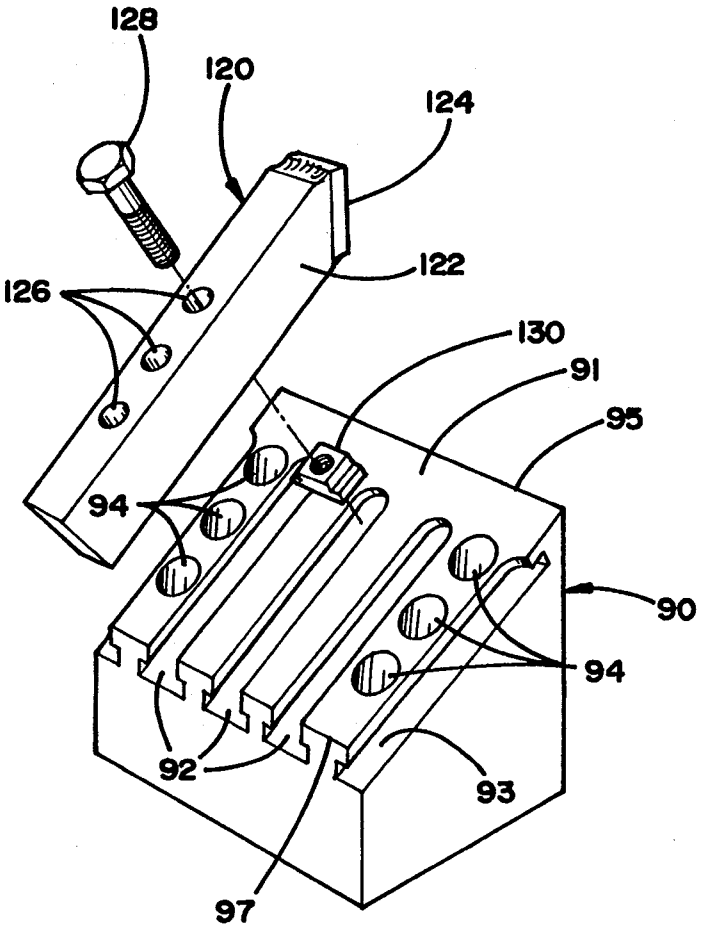
FIG. 10 is an exploded view of the hog hammer and tool holder according to the invention.

Referring to FIG. 10, the hog hammer 120 mounts to the tool holder 90. The hog hammer 120 comprises body 122 and hammer tip 124. The body 122 has mounting holes 126. The hog hammer 120 can mount to the tool holder in a manner similar to the chipper knife holder 100 by T-nuts and socket head cap screws. However, FIG. 10 shows an alternate mounting using T-bolts 128 slidably mounted in T-slots 92 and projecting through the aligned mounting holes 94, 126 of the tool holder 90 and hog hammer 120 with nuts 130 threaded onto the ends of the T-bolts 128. The chipper knife holder 100 can also mount using the T-bolts and nuts. The hog hammers 120 are preferably mounted in the T-slots 92 which are not aligned with the disc 40 so as not to impede the rearward movement of the hog hammer 120 when it encounters an unbreakable object.

In operation, the material, such as wooden pallets, is placed on the infeed conveyor 12. The material rides on the infeed conveyor 12 until it is disposed below the feedwheel 14 which pushes the material along with the infeed conveyor onto the adjustable anvil 16, bringing the material within reach of the disc assembly 18. The feedwheel slide system 13 by its weight partially crushes and compacts the waste material before it reaches the disc assembly 18. The vertical position of the feedwheel 14 is automatically adjusted when necessary to prevent binding of the feedwheel slide system 13 by the hydraulic cylinders 15. Each hydraulic cylinder 15 comprises a piston 132, 133 mounted to a rod 134, 135 which move internally to a cylinder 136, 137. The ends of the rods 134 are mounted to the slide box 15 which mounts the feedwheel 14 and slides within the box frame 154. The cylinders 15 are mounted to the box frame 154 of the waste processing machine 10. A hydraulic line 138 connects the top of cylinder 136 to the bottom of cylinder 137. Hydraulic line 140 connects the top of cylinder 137 to the bottom of cylinder 136 after passing through a direction control valve 142. A hydraulic pump 144 and hydraulic fluid reservoir 146 are connected to the direction control valve 142 by hydraulic lines 148, 150, respectively.

When material passes between the conveyor 12 and feedwheel, the feedwheel will automatically ride up over the material. Because of the length of the feedwheel, if the load is offset from the center, the slide mechanism may tend to bind.

When the lifting force imparted by the material on the feedwheel 14 causes the rod 134 to lift, the fluid in the top of the cylinder is forced down hydraulic line 138, into the bottom of the cylinder 137 by piston 132 and exerts a lifting force on the bottom of the piston 133 in cylinder 137. The fluid in the top of cylinder 137 then passes through hydraulic line 140, to fill the void at the bottom of cylinder 136, equalizing the fluid in both cylinders. Both pistons move up and down in equal distances, causing the feedwheel 14 to remain level. If a lifting force is encountered at the opposite end, the oil moves along hydraulic lines 138 and 140 in the opposite direction, producing the same result.

The feedwheel 14 can be lifted with or without an incoming load by passing through the control valve 142 from the hydraulic pump 144, fluid exerting a force on the bottom of piston 132 producing a lifting action, producing an equal lifting force at the bottom of piston 133. The fluid from the top of the piston 133 flows through the control valve 142 back to the hydraulic reservoir 146. Similarly, a downward pressure can also be put on the top of cylinder 137 to force the slide box down.

After the material is passed through the feedwheel 14, the material is contacted by whatever tool combination of swing hammers 50, chipper knives 106 and hog hammers 120 is mounted to the disc assembly 18, breaking or chipping the material into a mulch. By simultaneously using all three tools or a combination of the three tools, a very efficient waste processor is obtained. Assuming all three tools are mounted to the disc assembly 18, the swing hammers 50 contact the waste first, further crushing and compacting the waste while drawing the waste closer to the disc assembly 18. The hog hammers 120 will contact the waste second and further crush and compact the waste. The chipper knives will then chip the compacted material into even finer pieces. It is beneficial that the swing hammers 50 and hog hammers 120 crush and compact the material because the knives 106 of the chipper knife holder 100 cut compacted material more efficiently than loose, springy material.

The centrifugal force imparted by the chipper knife holders 100, swing hammers 50 or hog hammers 120 to the mulch will force the material into the discharge tube 20. The processed material is then removed from the discharge tube by the screw conveyor 24 which removes the process material to an awaiting container or to the impeller 22 which throws the process material out the thrower discharge 26. If desired, the impeller 22 and thrower discharge 26 can be replaced with a disc type chipper which could reduce the output from the recycler to smaller chips.

The tool selection is controlled by the type of waste being processed. If the material being processed is "clean" (having no metal or rocks), then only knives 106 are mounted to the tool holders 90. If the material being processed is slightly "dirty," (having some rock and dirt fragments), the preferred combination includes only swing hammers 50 and chipper knives 106 . The swinging hammers also clean sand and rocks from wood waste (such as tree stumps) before they reach the chipper knives 106 which greatly increases the capacity to use chipper knives 106, which in turn will increase the productivity of the waste processing machine 10. It is possible and sometimes desireable to use a combination of swing hammers 50, chipper knives 106 and hog hammers 120. If the chipper knives 106 and hog hammers 120 are used simultaneously, it is preferred that the chipper knives 106 and hog hammers 120 are alternately mounted to the tool holders 90. If the material being processed contains metal, the chipper knives 106 are generally not used and only hog hammers 120 are mounted to the tool holders 90. A combination of swing hammers and hog hammers is generally used for "dirty" material containing metal.

The swing hammers 50 are positioned on the discs 40 so that they move between the stationary hammers. The swing hammers 50 and the stationary hammers 32 will usually break any material caught between them into smaller pieces, unless the material is too large to break. The stationary hammers 32 provide a surface for trapping material so that the hammer 54 of the swing hammer 50 contacts the material approximately perpendicular to the surface of the material, rather than a glancing blow.

If the hog hammer 120 is used, the body 122 of the hog hammer 120 will contact the material imparting the centrifugal force of the disc assembly 18 to the material, causing the material to break into smaller pieces. If the hog hammer 120 contacts material which cannot be broken, the resulting impact will force the hog hammer to slide down the mounting surface 91 of the tool holder 90. The hog hammer 120 can slide down the mounting surface 91 until it is disposed equal to or behind the circumference of the disc 40, preventing further damage to the hog hammer and disc assembly. The waste processing machine 10 will then be turned off and the unbreakable material will be removed. The hog hammer 120 is then manually returned to its original position and the waste processing machine 10 can be restarted.

Reasonable variation and modification are possible within the spirit of the foregoing specification and drawings without departing from the scope of the invention.

The embodiments for which an exclusive property or privilege is claimed are defined as follows:

1. An apparatus for comminuting and chipping waste material comprising:

a substantially cylindrical housing having an inlet opening on one side thereof and an outlet opening on another side thereof, a main shaft mounted axially within the housing, said main shaft being connected to a drive means for rotating the main shaft within the housing, at least two discs disposed axially on the main shaft for rotation therewith, a bearing shaft extending between said at least two discs, swinging hammers rotatably mounted to the bearing shaft between the at least two discs, retaining means for retaining the swinging hammers within the periphery of the at least two discs, mounting means on at least one disc for selectively and releasably mounting non-swinging hammers and knives to the at least one disc, so that any combination of the swinging hammers, non-swinging hammers, and knives can be selected for use in a single apparatus to comminute a variety of waste materials.

2. An apparatus for comminuting and chipping waste material according to claim 1 further comprising a stationary hammer mounted to the housing and projecting radially inwardly of the housing to a point near the periphery of the at least two discs.

3. An apparatus for comminuting and chipping waste material according to claim 2 wherein the mounting means comprises a tool support mounted to a disc near the periphery thereof.

4. An apparatus for comminuting and chipping waste material according to claim 1 wherein one stationary hammer is mounted to the housing in approximately the same plane as each disc and another stationary hammer is mounted to the housing approximately midway between the planes of adjacent discs.

5. An apparatus for comminuting and chipping waste material according to claim 3 further comprising a non-swinging hammer mounted to the tool support, said non-swinging hammer having a portion thereof extending beyond the periphery of the disc.

6. An apparatus for comminuting and chipping waste material according to claim 3 wherein the tool support is radially spaced 45 degrees from the bearing shaft along the periphery of one of the at least two discs.

7. An apparatus for comminuting and chipping waste material according to claim 3 further comprising a non-swinging hammer mounted to the tool support, said non-swinging hammer having a portion thereof extending beyond the periphery of the disc.

8. An apparatus for comminuting and chipping waste material according to claim 7 wherein each of the at least two discs has a disc aperture disposed radially inwardly from the periphery of each of said at least two discs, said disc apertures being aligned, and the swinging hammer comprises a shank having a base aperture extending therethrough, said base aperture being positioned so as to be aligned with the disc apertures when the swinging hammer is rotated radially inwardly, whereby the swinging hammer can be fixed relative to the at least two discs when a single rod is received in the disc apertures and the shank aperture.

9. An apparatus for comminuting and chipping waste material according to claim 8 wherein the swinging hammer has a bearing surface extending around the bearing shaft.

10. An apparatus for comminuting and chipping waste material according to claim 9 wherein the coefficient of friction between the bearing surface and the bearing shaft is not less than 0.20.

11. An apparatus for comminuting and chipping waste material according to claim 9 wherein the tool support comprises a block having a leading edge and a trailing edge, the leading edge being disposed in the direction of rotation of the disc, the block further having a mounting surface extending between the leading edge and the trailing edge, said mounting surface being coincident with an imaginary plane sloping from the leading edge toward the trailing edge at an acute angle from an imaginary line intersecting the plane at a tangent point on the periphery of the disc.

12. An apparatus for comminuting and chipping waste material according to claim 11 wherein the tool support is radially spaced 45 degrees from the bearing shaft along the periphery of one of the at least two discs.

13. An apparatus for comminuting and chipping waste material according to claim 12 wherein the block extends axially of the disc to meet an adjoining block on an adjacent one of the at least two discs, thereby forming a single tool support extending between adjacent discs.

14. An apparatus for comminuting and chipping waste material according to claim 13 wherein parallel T-slots are disposed in the mounting surface along lines extending from the leading edge toward the trailing edge.

15. An apparatus for comminuting and chipping waste material according to claim 14 wherein the angle is 35 degrees.

16. An apparatus for comminuting and chipping waste material according to claim 15 wherein the block is recessed from the periphery of the disc.

17. An apparatus for comminuting and chipping waste material according to claim 16 wherein each block comprises opposed side edges extending from the leading edge to the trailing edge, three T-slots intermediate the side edges and a half T-slot at each side edge, whereby adjoining blocks will form a whole T-slot when the side edges on adjoining blocks are joined.

18. An apparatus for comminuting and chipping waste material according to claim 17 wherein the non-swinging hammer is mounted to the mounting surface by tightened bolts and nuts in the T-slots, providing for the non-swinging hammer to slide down the mounting surface if the non-swinging hammer cannot break the waste material.

19. An apparatus for comminuting and chipping waste material according to claim 18 comprising at least three stationary hammers disposed in substantially the same plane as one of the at least two discs, said outlet opening being disposed between two of the stationary hammers.

20. An apparatus for comminuting and chipping waste material according to claim 19 wherein there are four swinging hammers spaced 90 degrees apart along the periphery of the discs.

21. An apparatus for comminuting and chipping waste material according to claim 20 and further comprising a second tool support mounted to the at least two discs near the periphery thereof and a knife assembly mounted to the second tool support, said knife assembly having a portion thereof extending beyond the periphery of the disc.

22. An apparatus for comminuting and chipping waste material according to claim 21 wherein the knife assembly is mounted to the mounting surface of the second tool support by tightened bolts and nuts in the T-slots.

23. An apparatus for comminuting and chipping waste material according to claim 3 further comprising a knife assembly mounted to the tool support, said knife assembly having a portion thereof extending beyond the periphery of the disc.

24. An apparatus for cominuting and chipping waste material according to claim 23 wherein the knife assembly comprises a knife holder and a knife, said knife having a cutting edge disposed slightly radially outwardly of the periphery of the disc.

25. An apparatus for comminuting and chipping waste material according to claim 23 wherein each of the at least two discs has a disc aperture disposed radially inwardly from the periphery of each of said at least two discs, said disc apertures being aligned, and the swinging hammer comprises a shank having a base aperture extending therethrough, said base aperture being positioned so as to be aligned with the disc apertures when the swinging hammer is rotated radially inwardly, whereby the swinging hammer can be fixed relative to the at least two discs when a single rod is received in the disc apertures and the shank aperture.

26. An apparatus for comminuting and chipping waste material according to claim 25 wherein the swinging hammer has a bearing surface extending around the bearing shaft.

27. An apparatus for comminuting and chipping waste material according to claim 26 wherein the coefficient of friction between the bearing surface and the bearing shaft is not less than 0.20.

28. An apparatus for comminuting and chipping waste material according to claim 23 wherein the tool support comprises a block having a leading edge and a trailing edge, the leading edge being disposed in the direction of rotation of the disc, the block further having a mounting surface extending between the leading edge and the trailing edge, said mounting surface being coincident with an imaginary plane sloping from the leading edge toward the trailing edge at an acute angle from an imaginary line intersecting the plane at a tangent point on the periphery of the disc.

29. An apparatus for comminuting and chipping waste material according to claim 28 wherein the tool support is radially spaced 45 degrees from the bearing shaft along the periphery of one of the at least two discs.

30. An apparatus for comminuting and chipping waste material according to claim 29 wherein the block extends axially of the disc to meet an adjoining block on an adjacent one of the at least two discs, thereby forming a single tool support extending between adjacent discs.

31. An apparatus for cominuting and chipping waste material according to claim 30 wherein parallel T-slots are disposed in the mounting surface along lines extending from the leading edge toward the trailing edge.

32. An apparatus for comminuting and chipping waste material according to claim 31 wherein the angle is 35 degrees.

33. An apparatus for comminuting and chipping waste material according to claim 32 wherein the block is recessed from the periphery of the disc.

34. An apparatus for comminuting and chipping waste material according to claim 33 wherein each block comprises opposed side edges extending from the leading edge to the trailing edge, three T-slots intermediate the side edges and a half T-slot at each side edge, whereby adjoining blocks will form a whole T-slot when the side edges on adjoining blocks are joined.

35. An apparatus for comminuting and chipping waste material according to claim 34 wherein the knife assembly is mounted to the mounting surface by tightened bolts and nuts in the T-slots.

36. An apparatus for comminuting and chipping waste material according to claim 35 comprising at least three stationary hammers disposed in substantially the same plane as one of the at least two discs, said outlet opening being disposed between two of the stationary hammers.

37. An apparatus for comminuting and chipping waste material according to claim 36 wherein there are four swinging hammers spaced 90 degrees apart along the periphery of the discs.

38. An apparatus for comminuting and chipping waste material according to claim 3 wherein the tool support comprises a block having a leading edge and a trailing edge, the leading edge being disposed in the direction of rotation of the disc, the block further having a mounting surface extending between the leading edge and the trailing edge, said mounting surface being coincident with an imaginary plane sloping from the leading edge toward the trailing edge at an acute angle from an imaginary line intersecting the plane at a tangent point on the periphery of the disc.

39. An apparatus for comminuting and chipping waste material according to claim 38 wherein parallel T-slots are disposed in the mounting surface along lines extending from the leading edge toward the trailing edge.

40. An apparatus for comminuting and chipping waste material according to claim 38 wherein the angle is 35 degrees.

41. An apparatus for comminuting and chipping waste material according to claim 38 wherein the block is recessed from the periphery of the disc.

42. An apparatus for comminuting and chipping waste material according to claim 38 wherein the block extends axially of the disc to meet an adjoining block on an adjacent one of the at least two discs, thereby forming a single tool support extending between adjacent discs.

43. An apparatus for comminuting and chipping waste material according to claim 28 wherein parallel T-slots are disposed in the mounting surface along lines extending from the leading edge toward the trailing edge.

44. An apparatus for comminuting and chipping waste material according to claim 43 wherein each block comprises opposed side edges extending from the leading edge to the trailing edge, three T-slots intermediate the side edges and a half T-slot at each side edge, whereby adjoining blocks will form a whole T-slot when the side edges on adjoining blocks are joined.

45. An apparatus for cominuting and chipping waste material according to claim 44 wherein the non-swinging hammer is mounted to the mounting surface by tightened bolts and nuts in the T-slots, providing for the non-swinging hammer to slide down the mounting surface if the non-swinging hammer cannot break the waste material.

46. An apparatus for comminuting and chipping waste material according to claim 1 wherein each of the at least two discs has a disc aperture disposed radially inwardly from the periphery of each of said at least two discs, said disc apertures being aligned, and the swinging hammer comprises a shank having a base aperture extending therethrough, said base aperture being positioned so as to be aligned with the disc apertures when the swinging hammer is rotated radially inwardly, whereby the swinging hammer can be fixed relative to the at least two discs when a single rod is received in the disc apertures and the shank aperture.

47. An apparatus for comminuting and chipping waste material according to claim 1 wherein the swinging hammer has a bearing surface extending around the bearing shaft.

48. An apparatus for comminuting and chipping waste material according to claim 47 wherein the coefficient of friction between the bearing surface and the bearing shaft is not less than 0.20.

49. An apparatus for comminuting and chipping waste material according to claim 1 comprising at least three stationary hammers disposed in substantially the same plane as one of the at least two discs, said outlet opening being disposed between two of the stationary hammers.

50. An apparatus for comminuting and chipping waste material according to claim 49 wherein there are four swing hammers spaced 90 degrees apart along the periphery of the discs.

* * * * *